United States Patent [19]

Cremona

[11] Patent Number: 5,016,692

[45] Date of Patent: May 21, 1991

[54] VENEER CUTTING MACHINE FOR TREE TRUNKS WITH IMPROVED ANTIBENDING DEVICE

[75] Inventor: Lorenzo Cremona, Monza, Italy

[73] Assignee: Angelo Cremona & Figlio S.p.A., Milan, Italy

[21] Appl. No.: 517,668

[22] Filed: May 2, 1990

[30] Foreign Application Priority Data

May 5, 1989 [IT] Italy ..... 21021/89[U]

[51] Int. Cl.[5] ..... B27L 5/02

[52] U.S. Cl. ..... 144/213; 144/365

[58] Field of Search ..... 144/207 R, 213, 212, 144/365

[56] References Cited

U.S. PATENT DOCUMENTS

| | | | |
|---|---|---|---|
| 3,584,666 | 6/1971 | Jensen | 144/213 |
| 4,462,442 | 7/1984 | Pointer | 144/213 |
| 4,557,304 | 12/1985 | Shrum | 144/213 |
| 4,744,397 | 5/1988 | Cremona | 144/213 |

*Primary Examiner*—W. Donald Bray

*Attorney, Agent, or Firm*—Finnegan, Henderson, Farabow, Garrett & Dunner

[57] ABSTRACT

A rotary veneer-cutting machine for tree trunks including a blade holder unit (15, 16, 17, 18) that laterally approaches the axis of a trunk (12) to be cut and top rollers (25) and side rollers (31) counteracting the bending of the trunk (12) caused by the shearing stresses of the blade. The side rollers (31) are positioned diametrically opposite the blade (17) and are motor driven. A piston (39) supplies thrust action for the rollers (31) against the trunk so as to insure adherence thereto even with low bending stresses of the trunk.

11 Claims, 4 Drawing Sheets

VENEER CUTTING MACHINE FOR TREE TRUNKS WITH IMPROVED ANTIBENDING DEVICE

BACKGROUND OF THE INVENTION

As is known, a rotary veneer cutting machine for tree trunks is a machine which, by cutting action exerted by a blade placed laterally and parallel to the axially supported trunk between rotating chucks, removes therefrom a strip of wood of uniform and constant thickness and of a width equal to the length of the trunk.

The strip of wood cut from the trunk is compressed in order to stabilize the trajectory of penetration of the blade in the trunk, between the point of the blade and the point of a bar, termed pressure bar, parallel thereto. The action of the bar and blade in the contact zone thereof generates a force F acting on the trunk with variable direction and intensity during the veneer cutting process.

Said force can be resolved into a horizontal force directed toward the axis of the trunk and due principally to the aforesaid compression action of the rotary-cut veneer and into a vertical force directed upward and due principally to the static and dynamic resistance of the wood to distortion and to sliding on the blade and pressure bar and to the penetration force of the blade, which in turn depends on the physical and geometrical characteristics of the blade and wood and the degree of compression of the rotary-cut veneer.

It is thus clear that, other conditions being equal, the vertical component is highly variable with the peripheral speed of the trunk and decreases therewith. Due to the known principles of mechanics, the force F is equivalent to a force F equal and parallel thereto applied to the rotation axis of the trunk and a moment acting in a direction opposite that of said rotation.

While the moment only generates a torsional stress of the trunk and thus does not change the form and interaction conditions with the blade, the force F, distributed along the axis of the trunk, causes bending stress therein which tends to differentiate the conditions of the veneer cutting process along the length of the blade, causing irregularity in the thickness of the veneer and cracking and undulations generated by the difference in the development of the central part in relation to the side parts.

Moment M, even though it does not change the shape of the trunk, is the cause of another problem, especially for high-speed veneer-cutting machines designed to cut veneer from trunks down to a very small core diameter (on the order of 7–8 centimetres or less) to achieve high volumetric outputs. Given the small final diameter of the trunk the axially gripping jaws must have an equally small diameter and this means that at the beginning of the rotary veneer cutting the concentration of force thereon due to the moment M can reach such high values as to endanger the strength of the wood and consequently the rotating action.

To overcome these imperfections, the known art has placed counteracting supporting rollers acting on the opposite side of the trunk from the blade and on its top, i.e. along the two directions, vertical and horizontal, which make up the force F, so as to counteract the effect thereof, and in addition the top rollers have been motorized to exert an additional rotating action directly on the periphery of the trunk.

This solution however display problems, the first of which is that the vertical component of force F, as mentioned above, decreases progressively with the decrease in the diameter of the trunk and consequently the adherence available on the rotating rollers is highly variable and can become too small to allow correct rotation of the trunk.

It has also been thought to shift the top rollers toward the blade to attempt to at least partially balance force F by the rotating effort of said rollers. But this increases more than 90 degrees the angle between the top and side rollers and thus decreases the effectiveness of bending limitation.

The general object of the present invention is to obviate the above imperfections by providing a veneer-cutting machine with adequate means for always counteracting bending and compensating for the torque regardless of the operating conditions of the machine.

SUMMARY OF THE INVENTION

In view of said object in accordance with the invention, a rotary veneer-cutting machine for tree trunks is provided comprising a moving blade-holder assembly for the lateral approach of the blade to the trunk axis and rollers opposing bending and twisting of the trunk under the effect of the blade positioned above and at the side in a position virtually diametrically opposite the blade and characterized in that the top rollers are idling and the side rollers are motor-driven, the idling rollers and the driven rollers being mounted with their axis parallel to the axis of the trunk and on supports having means of thrust toward the surface of the trunk counteracting the bending forces generated by the blade in the trunk.

BRIEF DESCRIPTION OF THE DRAWINGS

To further clarify the explanation of the innovative principles of the present invention and its benefits compared with the known art there is described below with the aid of the annexed drawing a possible illustrative embodiment applying said principles. In the drawings

DETAILED DESCRIPTION OF THE INVENTION

Figure 1:
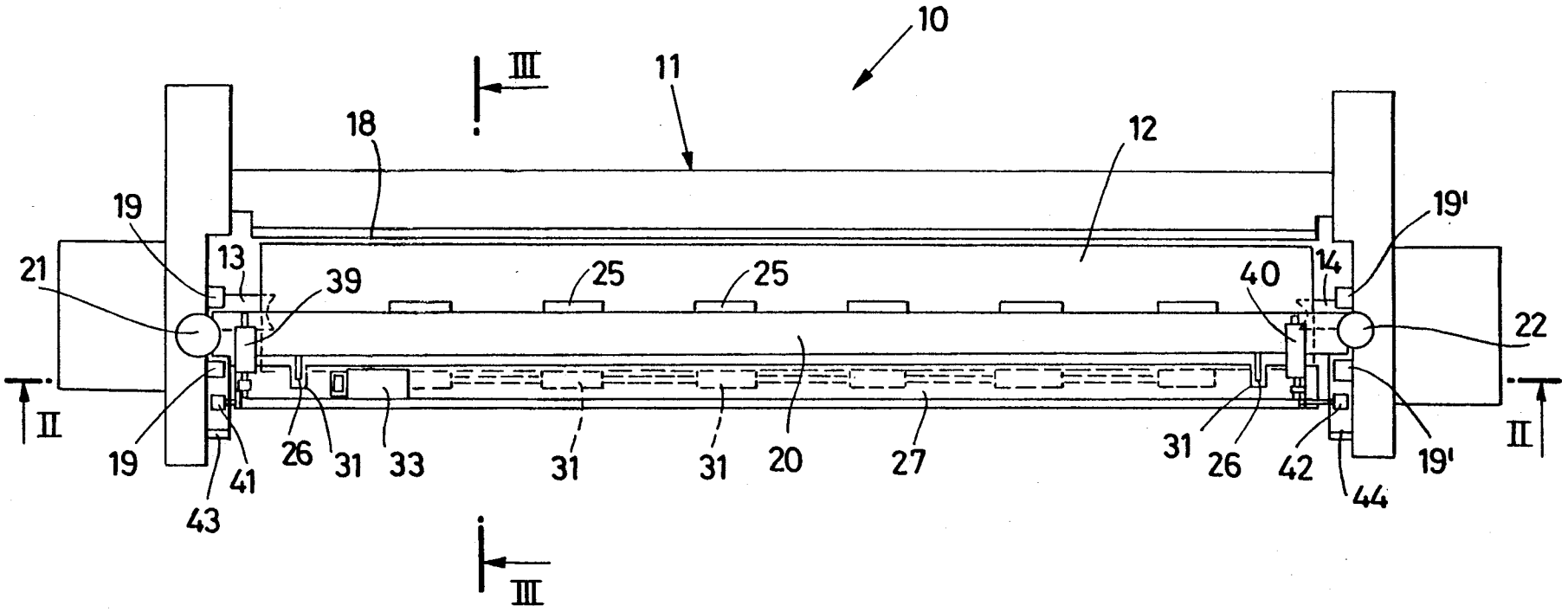
- FIG. 1 shows a schematic plan view of a veneer-cutting machine in accordance with the invention.

With reference to the figures, there is shown in FIG. 1 a veneer-cutting machine indicated generally by reference number 10 that, in accordance with the invention, comprises a cutting unit 11 moving toward a parallel trunk 12 positioned axially between the motor-driven jaws 13 and 14.

Figure 3:
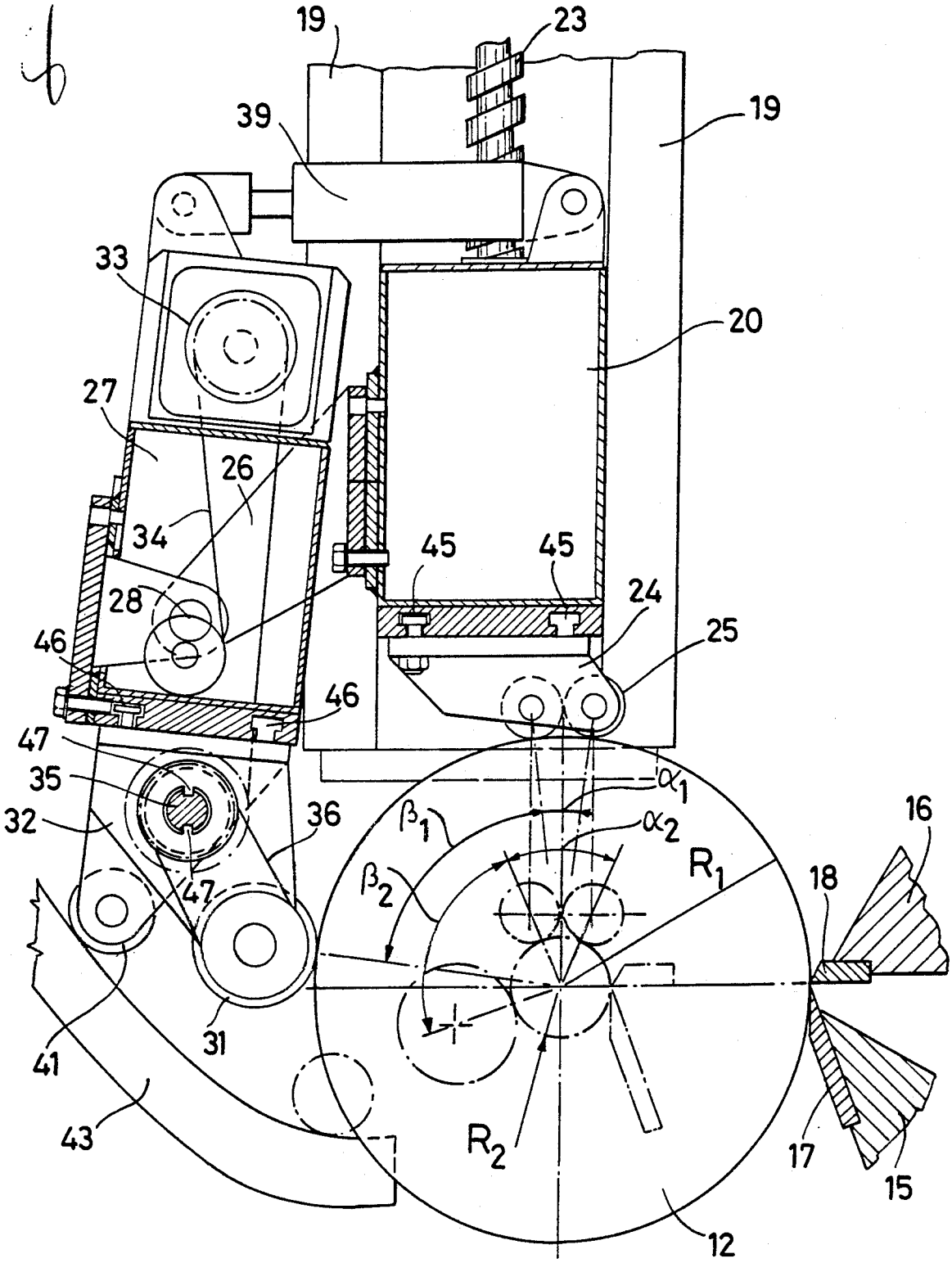
FIG. 3 shows a schematic partial cross-section view along line III—III of FIG. 1.

As may be partially seen in a schematic manner in FIG. 3, the cutting unit 11 is positioned beside the trunk and comprises supports 15 and 16 for a blade 17 and a pressure bar 18.

The means for movement of the blade toward the trunk and of regulation of the mutual position of the blade and pressure bar, as well as the means for rotation of the trunk around its axis, will not be futher described since they are conventional and the therefore within the knowledge of those skilled in the art.

Figure 2:
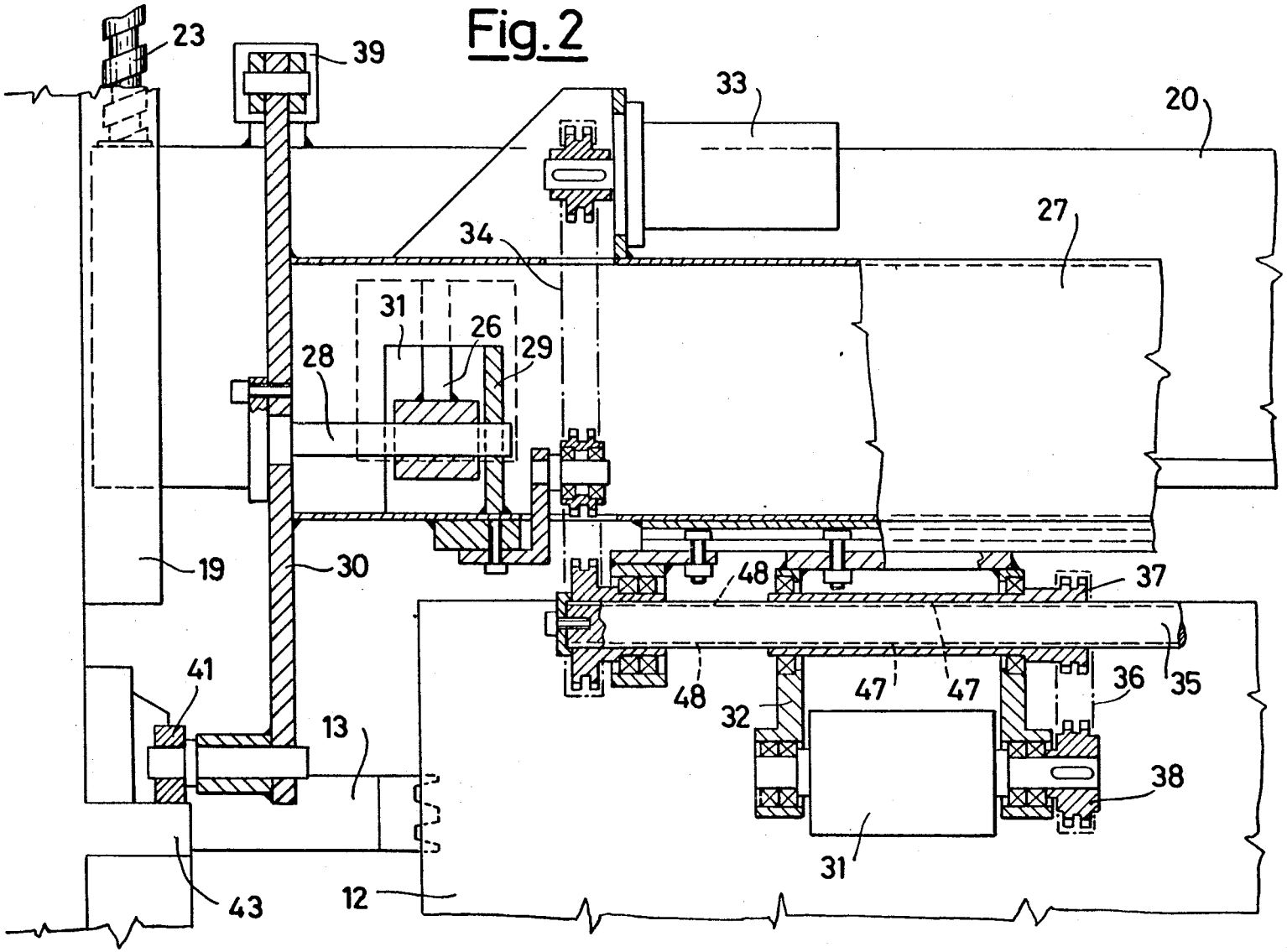
FIG. 2 shows a schematic partial cross-section view along line II—II of FIG. 1.

In accordance with the invention, on top of the trunk there are positioned at the ends thereof vertical guides 19, 19' for a box-type saddle beam 20 which moves along the guides by motor-driven means 21 and 22 e.g. by worm screws as shown schematically by reference number 23 in FIGS. 2 and 3 for one end of the beam 20, the other end being similar.

The beam 20 bears below, by means of a supporting framework 24, a plurality of pressure rollers 25 distributed at intervals along the length of the trunk in pairs so as to form two rows positioned symmetrically in relation to a vertical plane passing through the axis of the trunk 12.

In addition, the beam 20 has side supports 26 entering into a second box-type beam 27 through openings 31 for pivotal connection thereto. Said pivotal connection, which is formed of two identical supports for the two ends of the beam 27 but is described and shown only for one of them, comprises a pivot 28 passing through the support 26 and connected to the plate ends 29 and 30 fixed to the beam 27.

The beam 27 carry-from below, on supports 32, a plurality of pressure rollers 31 spaced along the length of and beside the trunk. Each roller 31 is connected for movement to a shaft 35 supported rotatively on the beam 27 and longitudinally with respect to the tree trunk, through a chain drive 36 between a toothed pulley wheel 38 keyed to the shaft of roller 31 and a toothed pulley wheel 37 mounted for rotation in the support 32 pulley wheel 37 engages in a sliding manner with the shaft 35 by means of longitudinal teeth 47 inserted in grooves 48 located along the entire length of the shaft 35.

The shaft 35 is in turn connected for motor-driven rotation of the rollers 31, to a motor 33 positioned above the beam 27 through a transmission 34, e.g. a chain drive.

Both the supports 24 and the supports 32 are movable axially with respect to the trunk along their respective beams by means of guide grooves 45, 46 respectively and in which are inserted the heads of bolts for positioning and locking the supports. In this manner it is possible to position at regular distances all the rollers against the trunk between the jaws even when the trunks are of varying length. This is made possible also by the sliding connection of the rollers 31 to the rotating shaft 35.

For rotation around the pivotal connection of the beam 27 there are provided, between the beam 20 and 27, linear actuators means 39 and 40, e.g. hydraulic or pneumatic pistons.

The beam 27 also carrys from below at the two ends, wheels 41 and 42 that slide along fixed guides 43 and 44.

Operation of the above described machine is as follows.

Figure 4:
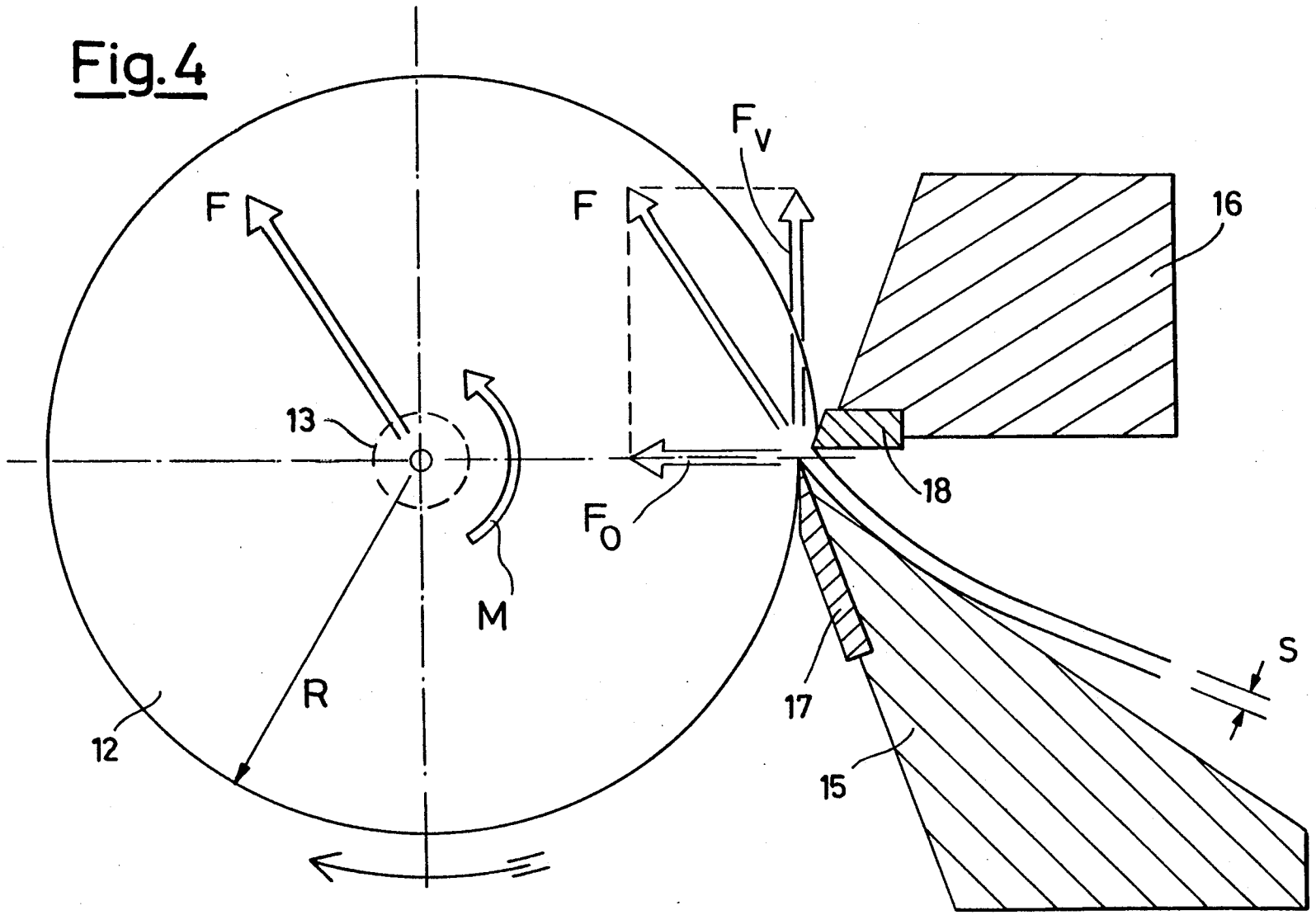
FIG. 4 shows a diagram of the forces acting on a trunk in a veneer-cutting machine.

During the veneer-cutting process, as mentioned above and shown schematically in FIG. 4, the cutting effort of the blade 17 and pressure bar 18 to produce a rotary-cut veneer of thickness s generates a force F which can be resolved into two forces Fv and Fo, equivalent thereto and transportable as the point of application to the axis of the trunk 12 by the addition of a moment M.

To obviate the problems which said forces and moments generate during veneer-cutting, after manually adjusting the position of the rollers along the trunk in such a manner that they are positioned at regular distances along it, the machine described rests on and holds in contact with the trunk the top rollers 25, by means of the thrust generated by the motor-driven means 21 and 22 synchronized with the movement of the blade, simultaneously the side rollers 31 are rotated by the motor 33 and thrust against the trunk by the combined action of the wheels 41, 42 and guides 43 and 44, and the actuator means 39, 40.

In this manner the bending forces are compensated for by the pressure of the rollers on the surface of the trunk.

The motor-driven rollers positioned laterally are subject to a virtually constant radial load (Fo depending on the degree of compression of the sheet of veneer which is virtually constant during the entire veneer cutting process) and hence it is possible to always hold their adherence at appropriate values for transmission of motion therefrom to the trunk with the resulting effective counteraction of the twisting moment M.

As may be seen in FIG. 3, the two rows of rollers 25, being positioned symmetrically in relation to a vertical plane passing through the axis of the trunk, form an angle at the centre which varies from a relatilvely small value $\alpha_1$, corresponding to an initial radius $R_1$ of the trunk, to a much larger value $\alpha_2$ corresponding to a final radius $R_2$, for which, the trunk having become quite small, high supporting action is necessary.

Simultaneously the angle included between the rollers 31 and the adjacent row of rollers 25 changes from a value $\beta_1$ to a value $\beta_2$, almost equal to each other and less than 90°, so as to have a continuously high limiting action in the lying quadrant of force F.

To ensure the rollers 31 are held in contact with the trunk, the guides 43 and 44 are shaped, as can be readily imagined by those skilled on the art, with a profile which follows the trajectory of the wheels 41 and 42 when they move the wheel units 31 and 25 toward the axis of the trunk while holding both of them at the same distance from said axis.

The thrust of the rollers 31 against the trunk is given predominantly by the action of the pistons 39 and 40 while the guides 43, 44 and the wheels 41, 42 limit the travel of the rollers 31 toward the outside of the trunk and consequently the flexure thereof, when the distortion force of the trunk exceeds the resistance of the pistons.

In this manner there is obtained the additional benefit of being able to endure a given minimum radial load on the rollers 31 to be used for adherence, also with low values of Fo resulting from certain adjustments of the cutting tools and/or the elastic characteristics of the wood.

Naturally the description given of a particular embodiment applying the innovative principles of the present invention is presented as an example of said principles and therefore is not to be taken as a limitation of the scope of the exclusive rights claimed herewith.

For example, the kinematic mechanism for transmission of motion between the motor 33 and the rollers 31 can be of any kind, e.g. belt or gear, just as the position of the motor on the beam 27 can be different.

Furthermore, the beams 20 and 27 supporting the antibending device, although, the box form with rectangular cross section is found beneficial, can be of another form e.g. in the form of an L or a T with the obvious changes to the guides and connections, compatible with the requirements for rigidity as a whole.

Finally, the means for moving the beam 20 can be different from those schematically shown as worm screws, e.g. means consisting of a rack could be used.

Control means of the movement of the beam 20 along its guides and of the pistons 39, 40 can be by means of an electronic similar to those used in the known art etc., as can readily be appreciated by those skilled in the art.

What is claimed is:

1. A rotary veneer cutting machine for cutting sheets of veneer from tree trunks comprising rotating means for rotatably supporting a trunk to be cut, a cutting blade having a cutting edge, means for bringing the cutting blade toward said tree trunk with its cutting edge extending parallel to the axis of rotation of the trunk, two sets of rollers mounted for rotation about axis parallel to the axis of the trunk, a first set of rollers comprising a plurality of idling rollers spaced along the axial length of the tree trunk and located substantially in a first plane that is perpendicular to a second plane that passes through the axis of rotation of the trunk and the edge of the cutting blade and a second set comprising a plurality of driven rollers spaced along the axial length of the tree trunk and substantially located opposite the cutting blade in said second plane, means for rotating said second set of rollers and thrust and actuator means for thrusting both said sets of rollers against the perimeter of the trunk to counteract bending and twisting of the trunk during cutting thereof and for keeping the said sets of rollers in contact with the trunk as its diameter varies.

2. The rotary veneer cutting machine of claim 1, in which the thrust and actuator means comprises a saddle beam extending along the axial of the tree trunk and moveable along a plane that contains it and is parallel to said first plane, said first set of rollers being rotatably supported along said saddle beam, means for moving said beam in its plane toward and away from the tree trunk, arms pivotally connected to said saddle beam that rotably support said second set of rollers and actuators between said arms and the saddle to pivot arms about their pivotable connection to bring said second set of rollers into contact with the trunk.

3. The rotary veneer cutting machine of claim 2, wherein the actuators are hydraulic cylinders.

4. The rotary veneer cutting machine of claim 2, including guide means for maintaining the two sets of rollers at substantially the same radial distance from the axis of rotation of the trunk during cutting thereof.

5. The rotary veneer cutting machine of claim 4, wherein the guide means comprise guide wheels rotatably mounted on the arms that roll on appropriately shaped fixed guide surfaces.

6. The rotary veneer cutting machine of claim 1, including two prallel rows of idling rollers spaced along the axial length of the tree forming spaced pairs of rollers, the rollers in each pair being located symmetrically to either side of said first plane.

7. The rotary veneer cutting machine of claim 2, wherein said means for moving said saddle beam comprises vertical guides for guiding each end of the beam and a drive motor for moving said beams in said guides.

8. The rotary veneer cutting machine of claim 2, wherein said arms form a second beam located parallel to and along side said saddle beam, the ends of said second beam being pivotably connected to the saddle beam and the second set of rollers being rotatably supported along said second beam.

9. The rotary veneer cutting machine of claim 2, including means for adjusting the axial location of the rollers of the first and second sets of rollers.

10. The rotary veneer cutting machine of claim 2, wherein the means for rotating the second set of rollers comprises a shaft mounted for rotation parallel to the trunk, a drive motor for rotating the shaft and a transmission belt rotatably connecting the shaft to the second set of rollers.

11. The rotary veneer cutting machine of claim 10, wherein the transmission belt slides along the shaft to permit axial adjustment of the rollers of said second set of rollers.

* * * * *